US012552629B2

(12) United States Patent
Nishida et al.

(10) Patent No.: US 12,552,629 B2
(45) Date of Patent: Feb. 17, 2026

(54) PAPER SHEET STORAGE DEVICE AND PAPER SHEET HANDLING DEVICE

(71) Applicant: FUJITSU FRONTECH LIMITED, Tokyo (JP)

(72) Inventors: Mitsutaka Nishida, Inagi (JP); Masato Ikeda, Inagi (JP); Katsuo Takahashi, Inagi (JP); Yuji Tanaka, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 137 days.

(21) Appl. No.: 18/162,484

(22) Filed: Jan. 31, 2023

(65) Prior Publication Data

US 2023/0174336 A1 Jun. 8, 2023

Related U.S. Application Data

(63) Continuation of application No. PCT/JP2020/030096, filed on Aug. 5, 2020.

(51) Int. Cl.
*B65H 29/26* (2006.01)
*B65H 31/00* (2006.01)

(52) U.S. Cl.
CPC ..... *B65H 29/26* (2013.01); *B65H 31/00* (2013.01)

(58) Field of Classification Search
CPC ..... B65H 29/26; B65H 31/00; B65H 31/02
See application file for complete search history.

(56) References Cited

U.S. PATENT DOCUMENTS

| | | | | |
|---|---|---|---|---|
| 5,172,905 | A * | 12/1992 | Vanous | G03B 17/32 378/188 |
| 7,210,681 | B2 * | 5/2007 | Asako | B65H 9/00 271/298 |
| 2013/0099442 | A1 | 4/2013 | Takada | |
| 2019/0064725 | A1 * | 2/2019 | Terakado | G03G 15/6552 |

FOREIGN PATENT DOCUMENTS

| | | | |
|---|---|---|---|
| JP | 2906796 | B2 | 6/1999 |
| JP | 2012046301 | A | 3/2012 |
| JP | 2016155637 | A | 9/2016 |
| JP | 2016172629 | A | 9/2016 |
| JP | 2018027847 | A | 2/2018 |

OTHER PUBLICATIONS

ISR issued in International application No. PCT/JP2020/030096, mailed Sep. 15, 2020.
Written Opinion of the ISA issued in International application No. PCT/JP2020/030096, dated Sep. 15, 2020.

* cited by examiner

*Primary Examiner* — Thomas A Morrison
(74) *Attorney, Agent, or Firm* — GREER BURNS & CRAIN, LTD.

(57) ABSTRACT

A paper sheet storage device includes: a storage that stores a paper sheet inclined with respect to a horizontal direction in a storage space narrower than the paper sheet in width; and a guide portion that guides the paper sheet so as to cause the paper sheet to freely fall in the storage space such that all sides of the paper sheet are inclined at an angle different from the horizontal direction.

4 Claims, 11 Drawing Sheets

PAPER SHEET STORAGE DEVICE AND PAPER SHEET HANDLING DEVICE

CROSS-REFERENCE TO RELATED APPLICATION

This application is continuation application of International Application PCT/JP2020/030096 filed on Aug. 5, 2020 and designated the U.S., the entire contents of which are incorporated herein by reference.

TECHNICAL FIELD

The present invention relates to a paper sheet storage device and a paper sheet handling device including the paper sheet storage device.

BACKGROUND ART

Conventionally, a paper sheet storage box has been proposed, in which a width of an internal accumulation space is set to be thin so that an input paper sheet cannot be accumulated in a state of being laid, and in which a partition plate that partitions a first accumulation space on an input port side and a second accumulation space on a lower side is provided so as to be openable by a predetermined load (see, for example, Japanese Patent No. 2906796).

SUMMARY OF INVENTION

A paper sheet storage device according to the present disclosure includes: a storage that stores a paper sheet inclined with respect to a horizontal direction in a storage space narrower than the paper sheet in width; and a guide portion that guides the paper sheet so as to cause the paper sheet to freely fall in the storage space such that all sides of the paper sheet are inclined at an angle different from the horizontal direction.

A paper sheet handling device according to the present disclosure includes a paper sheet storage device that includes: a storage that stores a paper sheet inclined with respect to a horizontal direction in a storage space narrower than the paper sheet in width; and a guide portion that guides the paper sheet so as to cause the paper sheet to freely fall in the storage space such that all sides of the paper sheet are inclined at an angle different from the horizontal direction.

The object and advantages of the present invention will be realized by the elements set forth in the claims or combinations thereof.

DESCRIPTION OF EMBODIMENTS

Incidentally, in the storage of paper sheets such as banknotes, the paper sheets are generally stored in a storage slightly larger than the size of the paper sheets while being aligned so that the storage space can be effectively utilized. In order to store the paper sheets while aligning the paper sheets in this manner, it is necessary to install a lifting mechanism or the like for lifting and lowering a stage so that the storage space of the paper sheets is always constant. The lifting mechanism is, for example, a spring for changing the height position of the stage according to the weight of the paper sheets, an electric lifting mechanism, or the like.

In addition, even in a case where the paper sheets are stored in a storage space narrower than the size of each of the paper sheets in width, it is necessary to incline a floor (stage) or install a lifting mechanism so that the paper sheets are stored in an obliquely aligned manner.

As described above, conventionally, paper sheets have been stored while being aligned in order to stabilize the number of stored paper sheets. However, a lifting mechanism and a movable component such as an impeller necessary for the storage are required, and the storage is expensive. However, since the behaviors of the paper sheets are not stable in a case where these movable components are not present, the paper sheets may collide with each other and the number of stored sheets may be extremely small. In particular, in a case where the paper sheets are stored in the storage by free fall, a phenomenon may occur in which the paper sheets are stacked vertically and a full state in which the storage is full of a small number of paper sheets is detected.

For recent automated teller machines (ATMs), there is a demand for downsizing cassettes and increasing the number of cassettes in order to increase the number of denominations to be handled, and there is a demand for downsizing (narrowing the width) storage-dedicated cassettes.

As described above, the configuration of the paper sheet storage box including the partition plate provided so as to be openable by a predetermined load is complex due to the arrangement of the openable partition plate.

Hereinafter, a paper sheet storage device and a paper sheet handling device according to an embodiment of the present invention will be described with reference to the drawings, where an example of the paper sheet storage device is referred to as a first reject storage 1, and an example of the paper sheet handling device is referred to as an automatic dealing apparatus 100.

Figure 1:
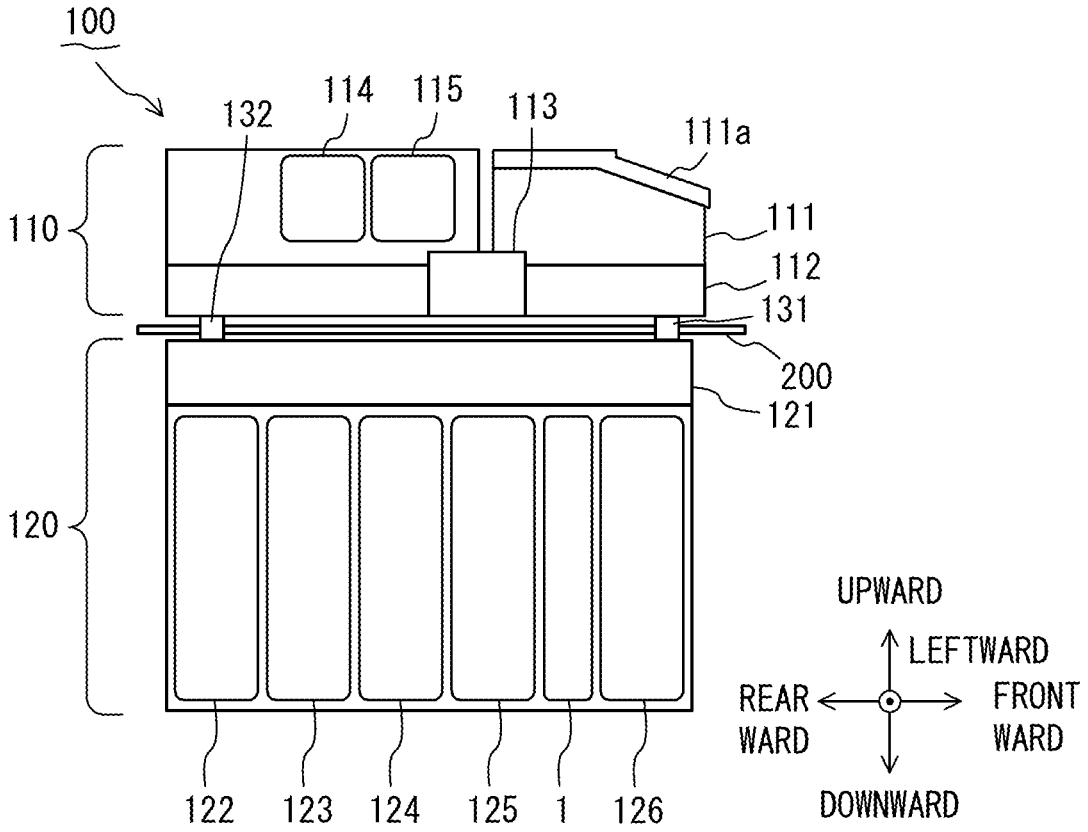
FIG. 1 is a left side view illustrating an internal configuration of an automatic dealing apparatus according to an embodiment.

FIG. 1 is a left side view illustrating an internal configuration of the automatic dealing apparatus 100.

Note that each of upward/downward, forward/backward, and leftward/rightward directions illustrated in FIG. 1 and FIGS. 2A to 10 described below is only an example in a case where it is assumed that a customer side of the automatic dealing apparatus 100 is the forward direction. However, for example, the upward/downward direction is a vertical direction, and the forward/backward direction and the leftward/rightward direction are horizontal directions.

The automatic dealing apparatus 100 illustrated in FIG. 1 is, for example, an ATM, a bill recycle unit (BRU), a cash dispenser (CD), a teller cash recycler (TCR), or the like, and includes a main body unit 110, a storage unit 120, and intermediate conveyance sections 131 and 132. The automatic dealing apparatus 100 performs processing such as depositing and withdrawing of a banknote B, which is an example of a paper sheet. Note that the paper sheet handling device may be only required to perform some sort of processing such as receiving (depositing), discharging (withdrawing), and conveying a paper sheet exemplified by the banknote B.

The main body unit 110 includes a banknote deposit/withdrawal unit 111, a main body conveyance section 112, a determination unit 113, and temporary holding parts 114 and 115.

The banknote deposit/withdrawal unit 111 includes a shutter 111*a*. The banknote B is inserted at the time of deposit and the banknote B is ejected at the time of withdrawal.

The main body conveyance section 112 is disposed at the bottom of the main body unit 110 and conveys the banknote B between the banknote deposit/withdrawal unit 111, the temporary holding parts 114 and 115, and the intermediate conveyance sections 131 and 132 to be described later.

The determination unit 113 is disposed on a conveyance route of the main body conveyance section 112 and determines authenticity, dirt, a creased corner, and the like of the banknote B.

The temporary holding part 114, which is one of the temporary holding parts 114 and 115, temporarily stores a banknote B determined to be normal by the determination unit 113, for example, by winding the banknote B. The other temporary holding part 115 temporarily stores a banknote B determined to be abnormal by the determination unit 113, for example, by winding the banknote B.

The storage unit 120 is disposed below the main body unit 110 and includes a storage conveyance section 121, banknote storages 122 to 125, a first reject storage 1, and a second reject storage 126.

The storage conveyance section 121 is disposed at the top of the storage unit 120 and conveys the banknote B between the main body unit 110 (the intermediate conveyance section 131 and the intermediate conveyance section 132) and each storage (the banknote storages 122 to 125, the first reject storage 1, and the second reject storage 126).

The banknote storages 122 to 125 store, for example, banknotes B of different denominations. The banknote storages 122 to 125 can discharge the stored banknotes B. Therefore, the banknotes B stored in the banknote storages 122 to 125 are used for withdrawal.

The first reject storage 1 and the second reject storage 126 store unreturned banknotes B among banknotes B determined to be abnormal by the determination unit 113, for example. In particular, banknotes B such as counterfeit banknotes are preferably stored in the first reject storage 1. The first reject storage 1 will be described later in detail with reference to FIGS. 5 to 10.

The main body unit 110 and the storage unit 120 described above are arranged in different spaces via a partition plate 200, and the intermediate conveyance sections 131 and 132 convey the banknote B so as to cause the banknote B to pass through the partition plate 200.

The intermediate conveyance section 131, which is one of the intermediate conveyance sections 131 and 132, conveys the banknote B so as to cause the banknote B to pass through the partition plate 200 on the front side of the automatic dealing apparatus 100. The other intermediate conveyance section 132 conveys the banknote B so as to cause the banknote B to pass through the partition plate 200 on the rear side of the automatic dealing apparatus 100.

Next, conveyance routes for the banknote B in the automatic dealing apparatus 100 will be described.

Figure 2A:
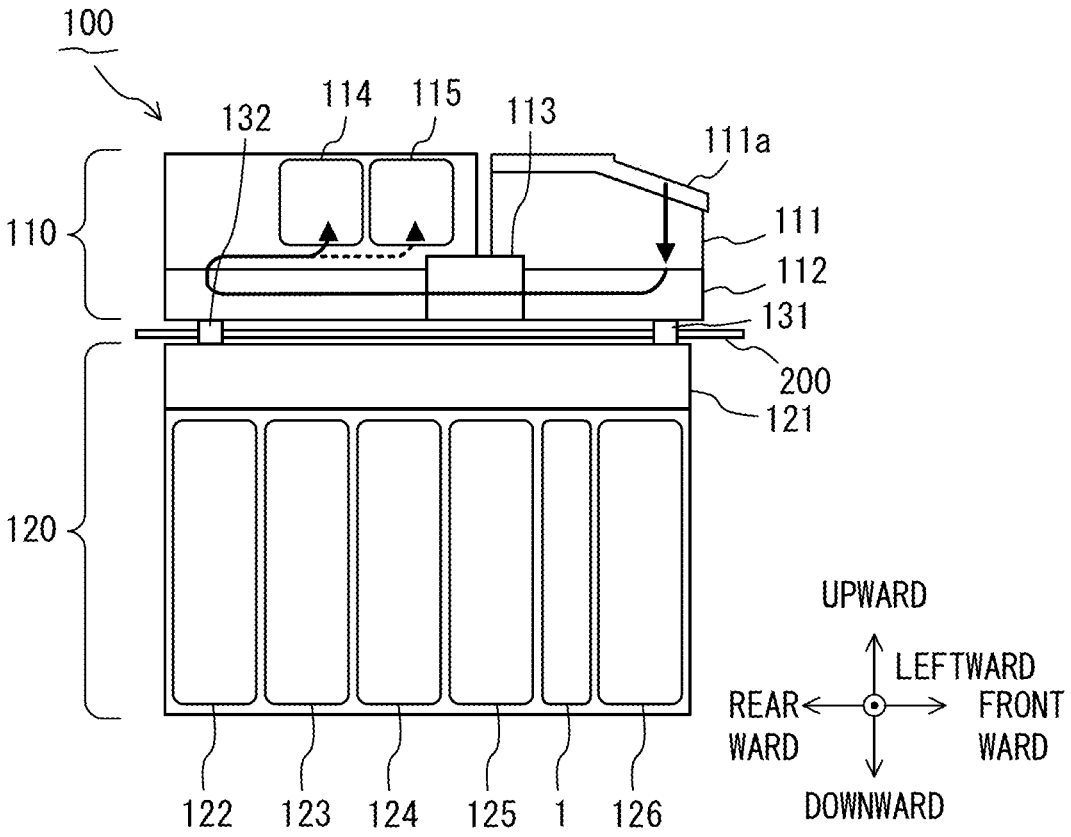
FIG. 2A is an explanatory diagram (part 1) for explaining a conveyance route via a temporary holding part in the automatic dealing apparatus according to the embodiment at the time of deposit.
Figure 2B:
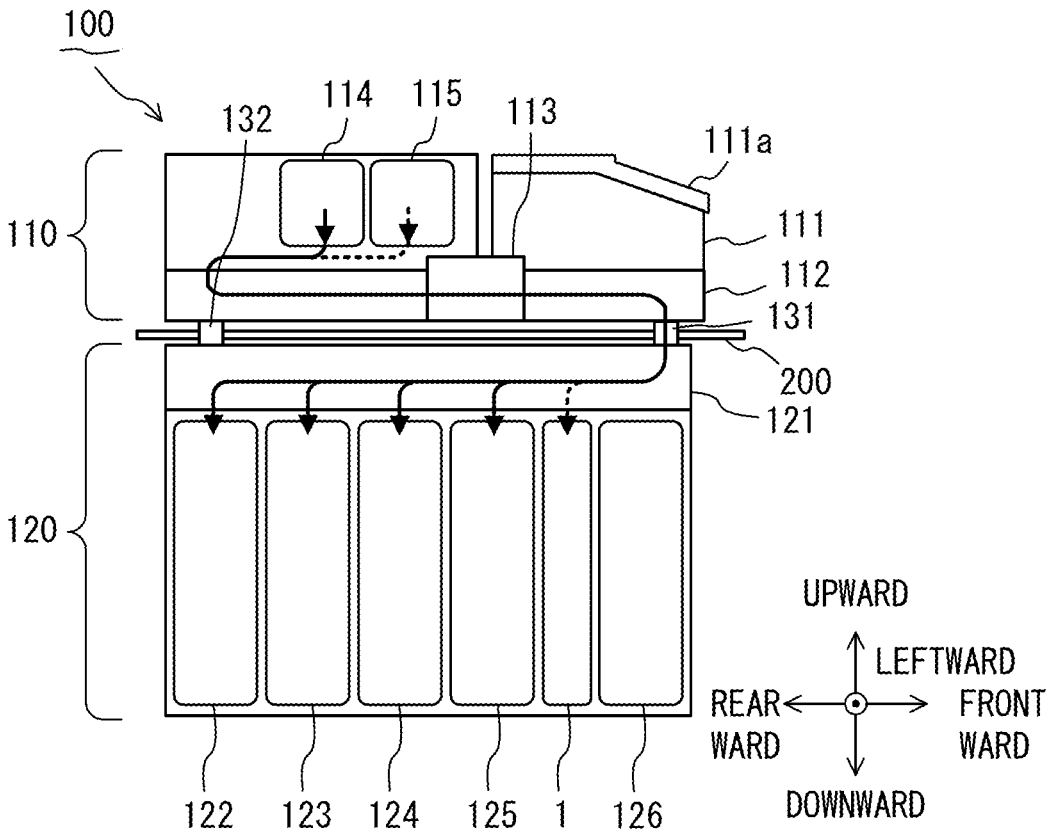
FIG. 2B is an explanatory diagram (part 2) for explaining the conveyance route via the temporary holding part in the automatic dealing apparatus according to the embodiment at the time of deposit.

FIGS. 2A and 2B are explanatory diagrams for explaining a conveyance route via the temporary holding part 114 or 115 in the automatic dealing apparatus 100 at the time of deposit.

Figure 3:
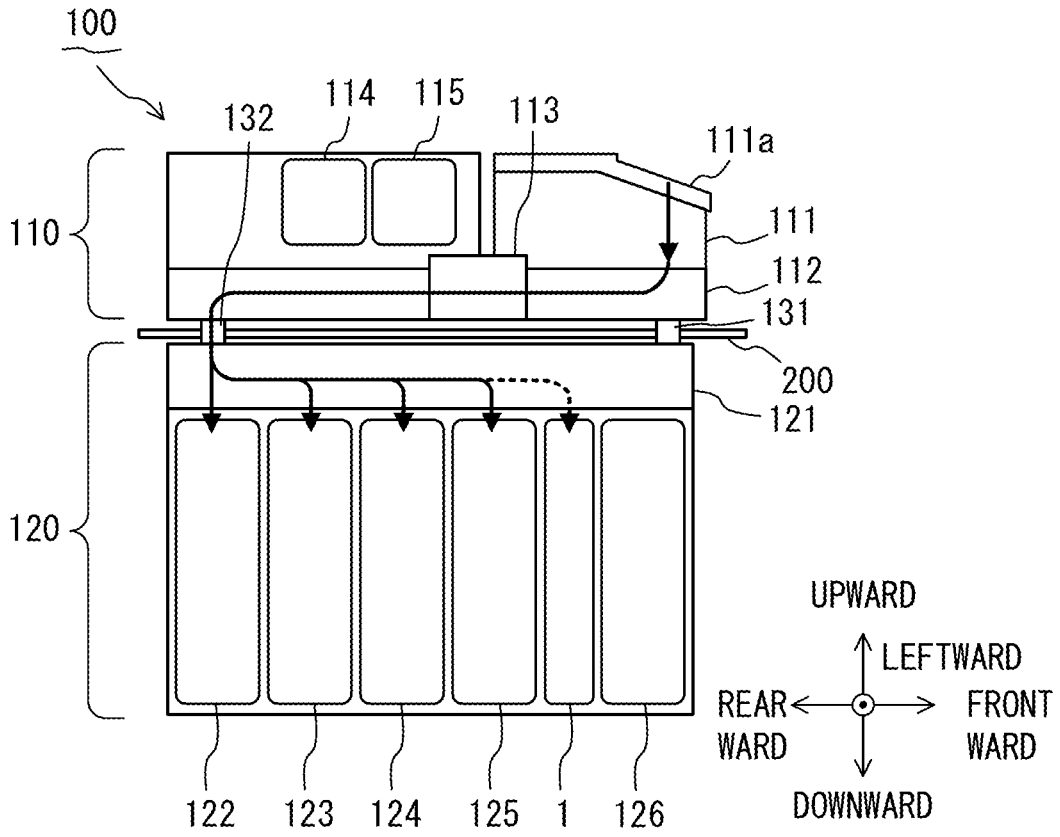
FIG. 3 is an explanatory diagram for explaining a conveyance route in the automatic dealing apparatus according to the embodiment at the time of direct deposit.

FIG. 3 is an explanatory diagram for explaining a conveyance route in the automatic dealing apparatus 100 at the time of direct deposit.

Figure 4:
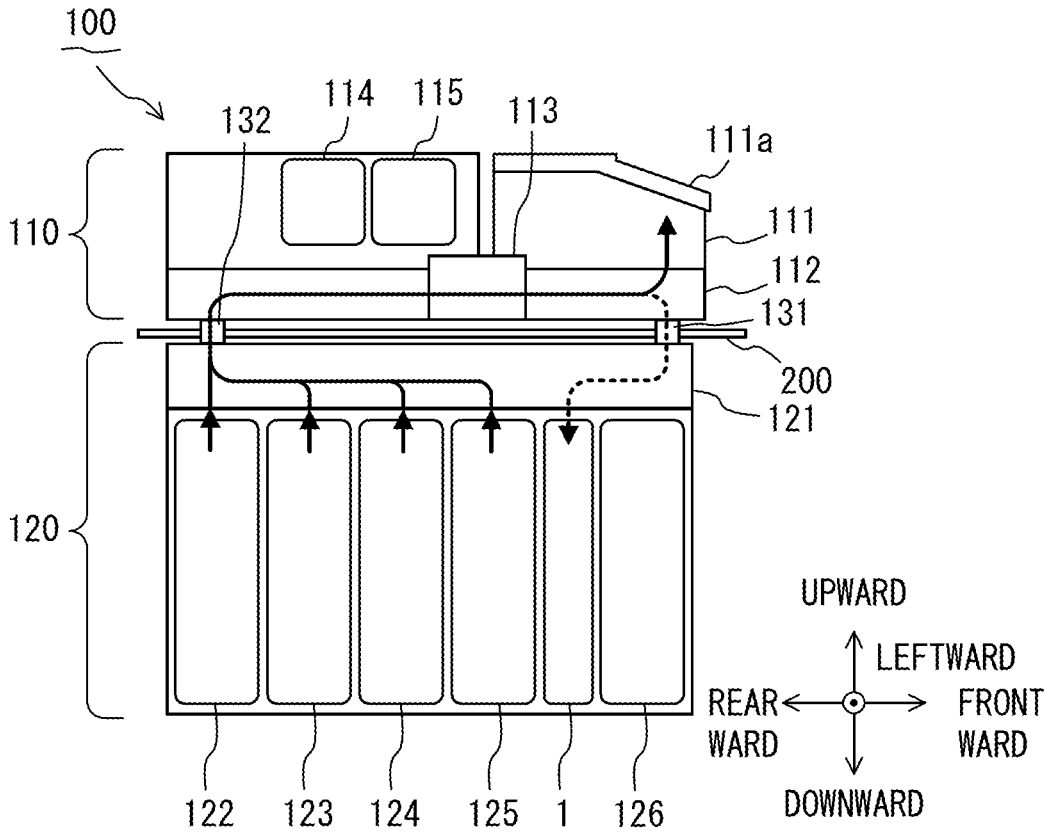
FIG. 4 is an explanatory diagram for explaining a conveyance route in the automatic dealing apparatus according to the embodiment at the time of withdrawal.

FIG. 4 is an explanatory diagram for explaining a conveyance route in the automatic dealing apparatus 100 at the time of withdrawal.

First, as indicated by a solid arrow in FIG. 2A, the banknote B inserted into the banknote deposit/withdrawal unit 111 is conveyed to the main body conveyance section 112, and authenticity, dirt, a creased corner, and the like of the banknote B are determined by the determination unit 113.

Thereafter, when the banknote B is determined to be normal by the determination unit 113, the banknote B is conveyed to the temporary holding part 114 as indicated by a solid arrow in FIG. 2A. On the other hand, when the banknote B is determined to be abnormal by the determination unit 113, the banknote B is conveyed to the temporary holding part 115 as indicated by a broken arrow in FIG. 2A.

Next, as indicated by solid arrows in FIG. 2B, the banknote B temporarily stored in the temporary holding part 114 is conveyed to each of the banknote storages 122 to 125 through the main body conveyance section 112, the intermediate conveyance section 131, and the storage conveyance section 121. On the other hand, the banknote B temporarily stored in the temporary holding part 115 passes through the main body conveyance section 112, the intermediate conveyance section 131, and the storage conveyance section 121 and is conveyed to the first reject storage 1 as indicated by a broken arrow in FIG. 2B. Note that the banknote B temporarily stored in the temporary holding part 115 may be conveyed to the second reject storage 126.

As indicated by solid arrows in FIG. 3, in a case where the banknote B is directly deposited without passing through the temporary holding parts 114 and 115, the banknote B inserted into the banknote deposit/withdrawal unit 111 is conveyed to the main body conveyance section 112, and authenticity, contamination, a creased corner, and the like of the banknote B are determined by the determination unit 113. Thereafter, when the banknote B is determined to be normal by the determination unit 113, the banknote B is conveyed to each of the banknote storages 122 to 125 through the intermediate conveyance section 132 and the storage conveyance section 121. On the other hand, when the banknote B is determined to be abnormal by the determination unit 113, the banknote B passes through the intermediate conveyance section 132 and the storage conveyance section 121 and is conveyed to the first reject storage 1 as indicated by a broken arrow.

As indicated by solid arrows in FIG. 4, when banknotes B are to be withdrawn from the banknote storages 122 to 125, the banknotes B stored in the banknote storages 122 to 125 are conveyed to the banknote deposit/withdrawal unit 111 through the storage conveyance section 121, the intermediate conveyance section 132, and the main body conveyance section 112. When the banknotes B stored in the banknote storages 122 to 125 are determined to be abnormal by the determination unit 113, the banknotes B may be conveyed to the first reject storage 1 through the intermediate conveyance section 131 and the storage conveyance section 121 as indicated by a broken arrow.

Figure 5:
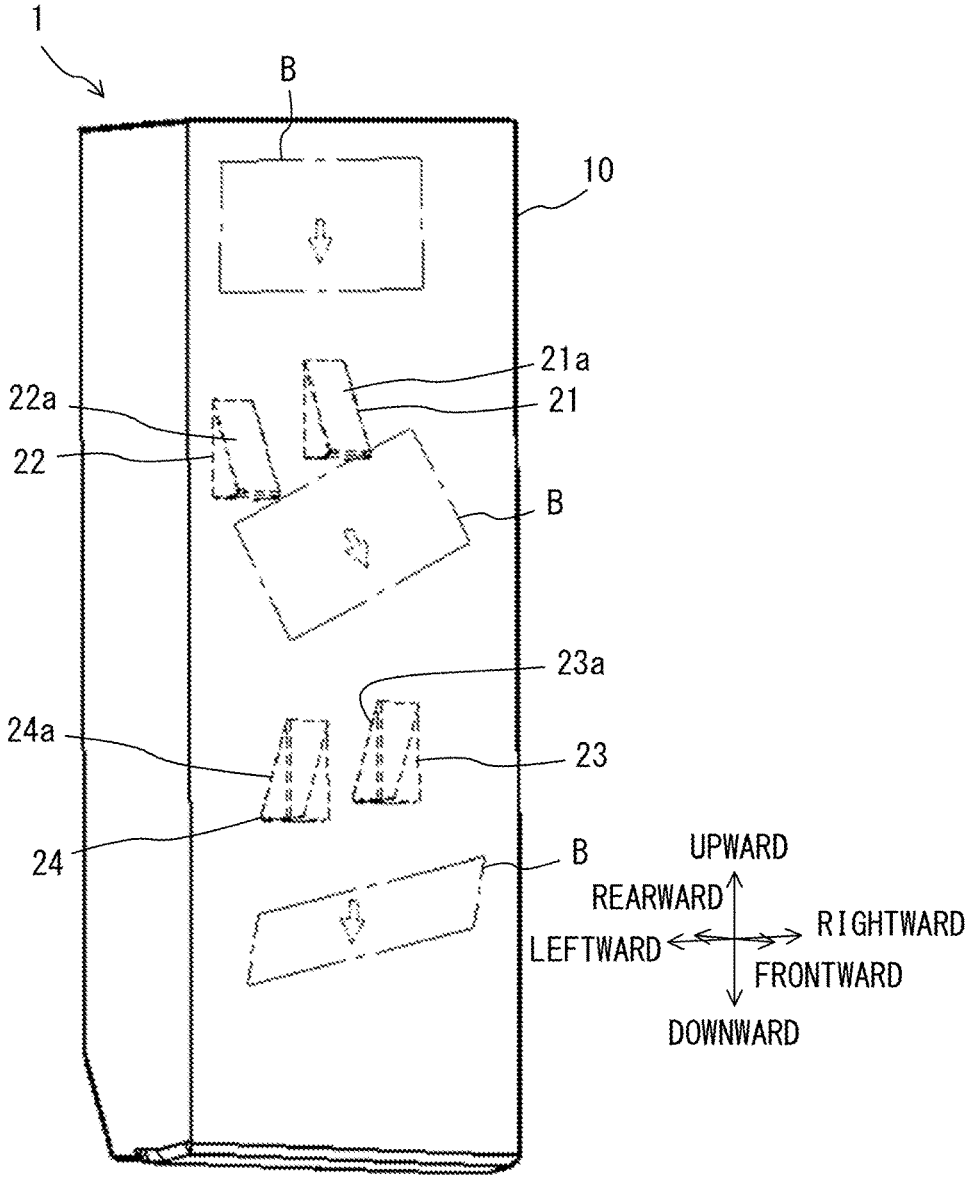
FIG. 5 is a perspective view illustrating an internal configuration of a part of a first reject storage according to the embodiment.

FIG. 5 is a perspective view illustrating an internal configuration of a part (first to fourth guide portions 21 to 24) of the first reject storage 1.

Figure 6:
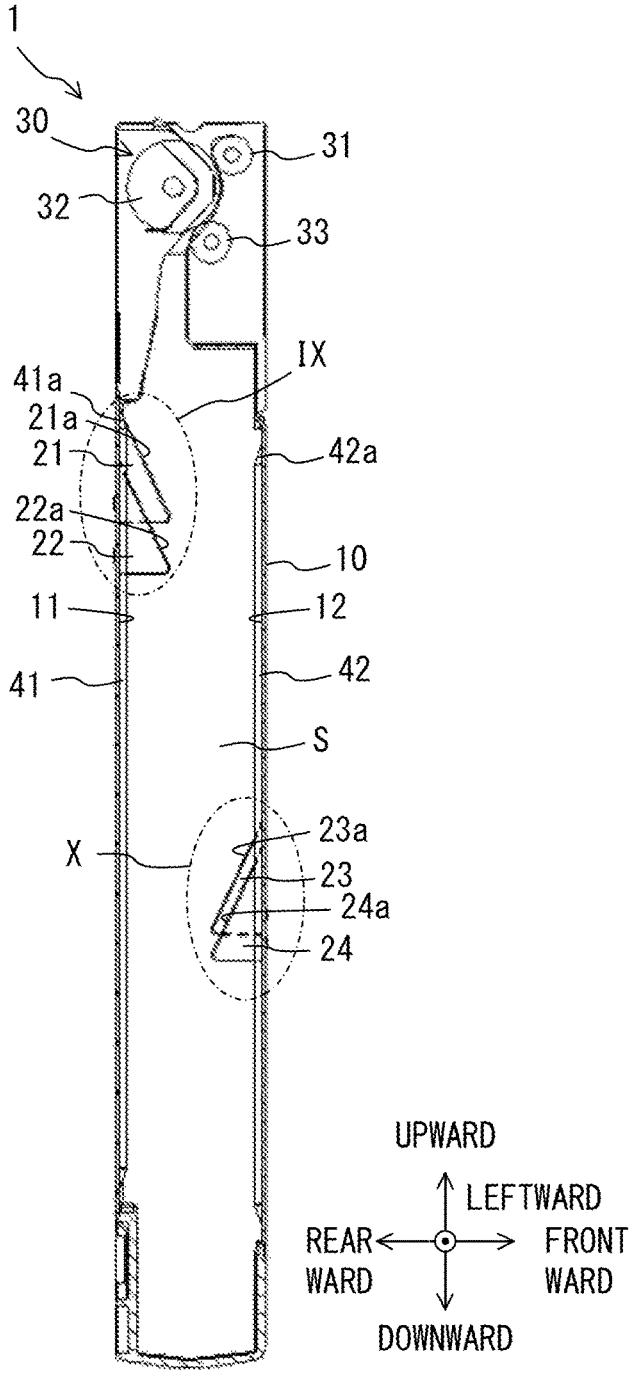
FIG. 6 is a left side view illustrating an internal configuration of the first reject storage according to the embodiment.

FIG. 6 is a left side view illustrating an internal configuration of the first reject storage 1.

Figure 7:
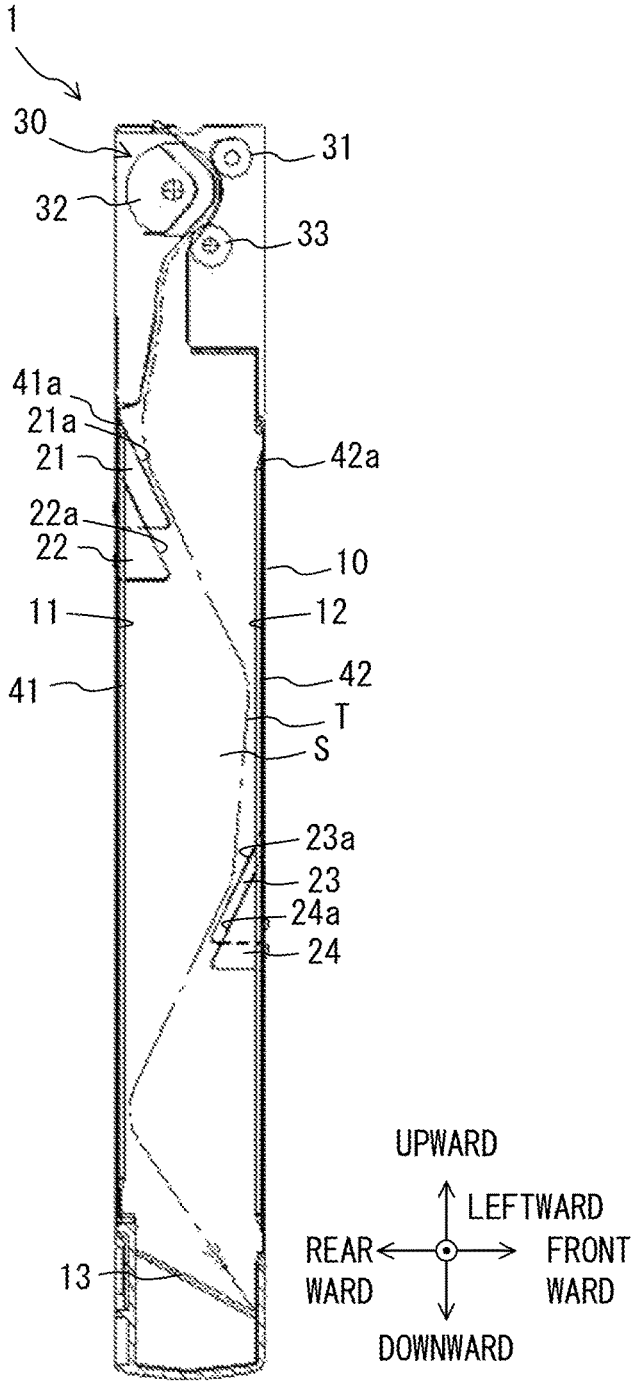
FIG. 7 is an explanatory view for explaining a fall trajectory in the first reject storage according to the embodiment.

FIG. 7 is an explanatory view for explaining a fall trajectory T in the first reject storage 1.

Figure 8:
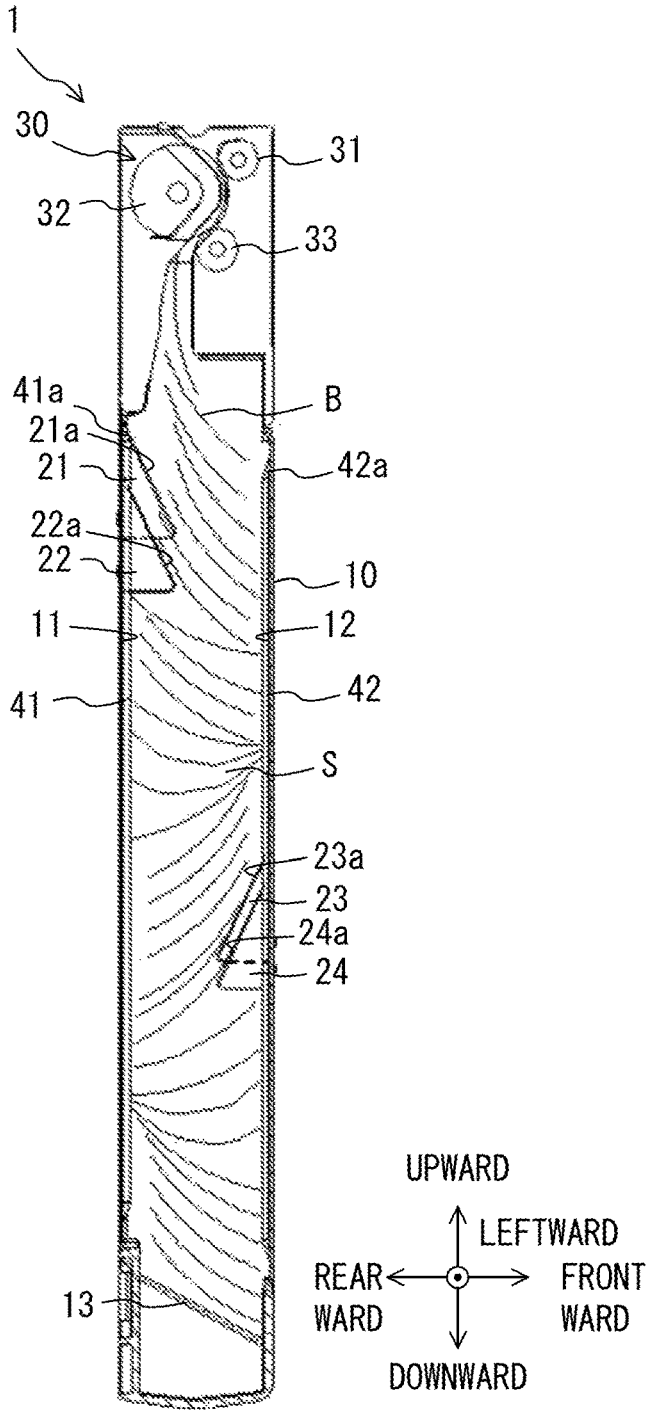
FIG. 8 is an explanatory view for explaining a storage state of a banknote in the first reject storage according to the embodiment.

FIG. 8 is an explanatory diagram for explaining a storage state of the banknote B in the first reject storage 1.

Figure 9:
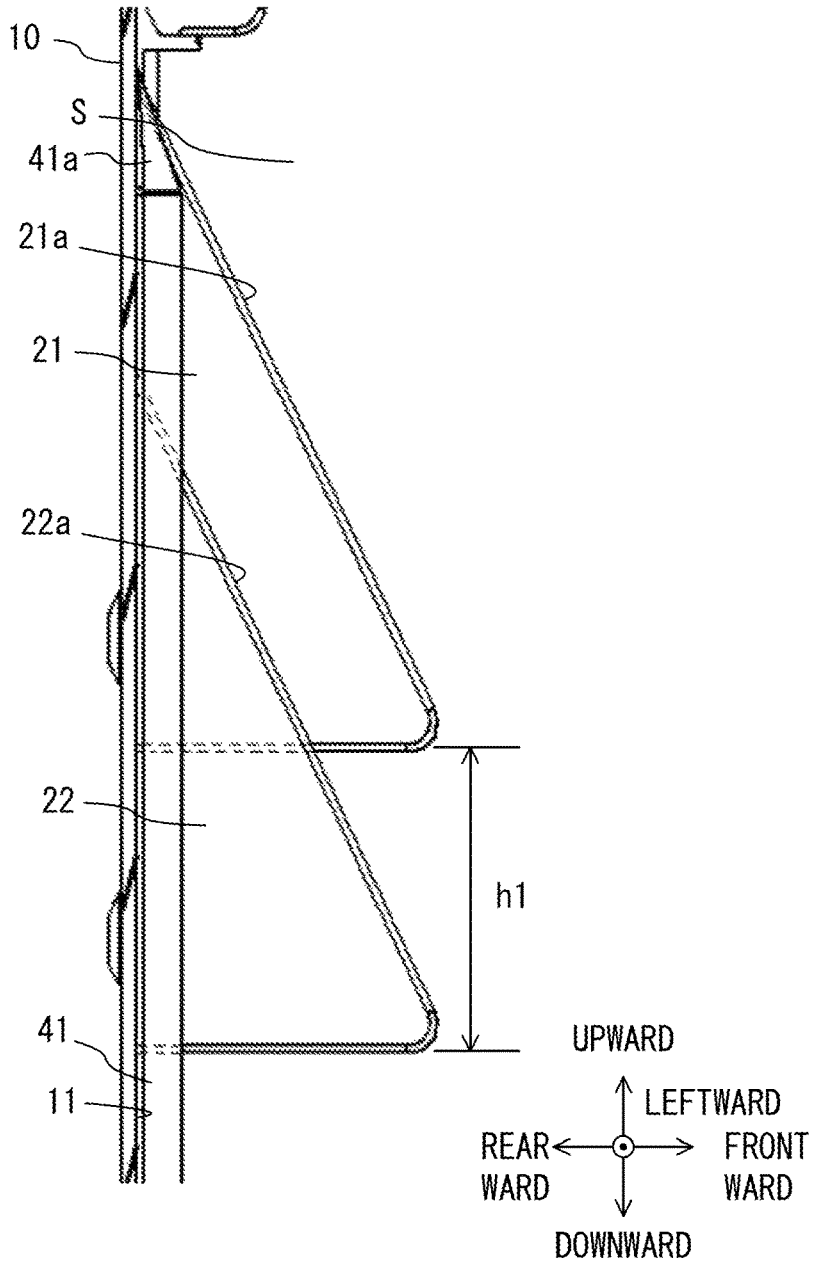
FIG. 9 is an enlarged view of a part IX illustrated in FIG. 6.

FIG. 9 is an enlarged view of a part IX illustrated in FIG. 6.

Figure 10:
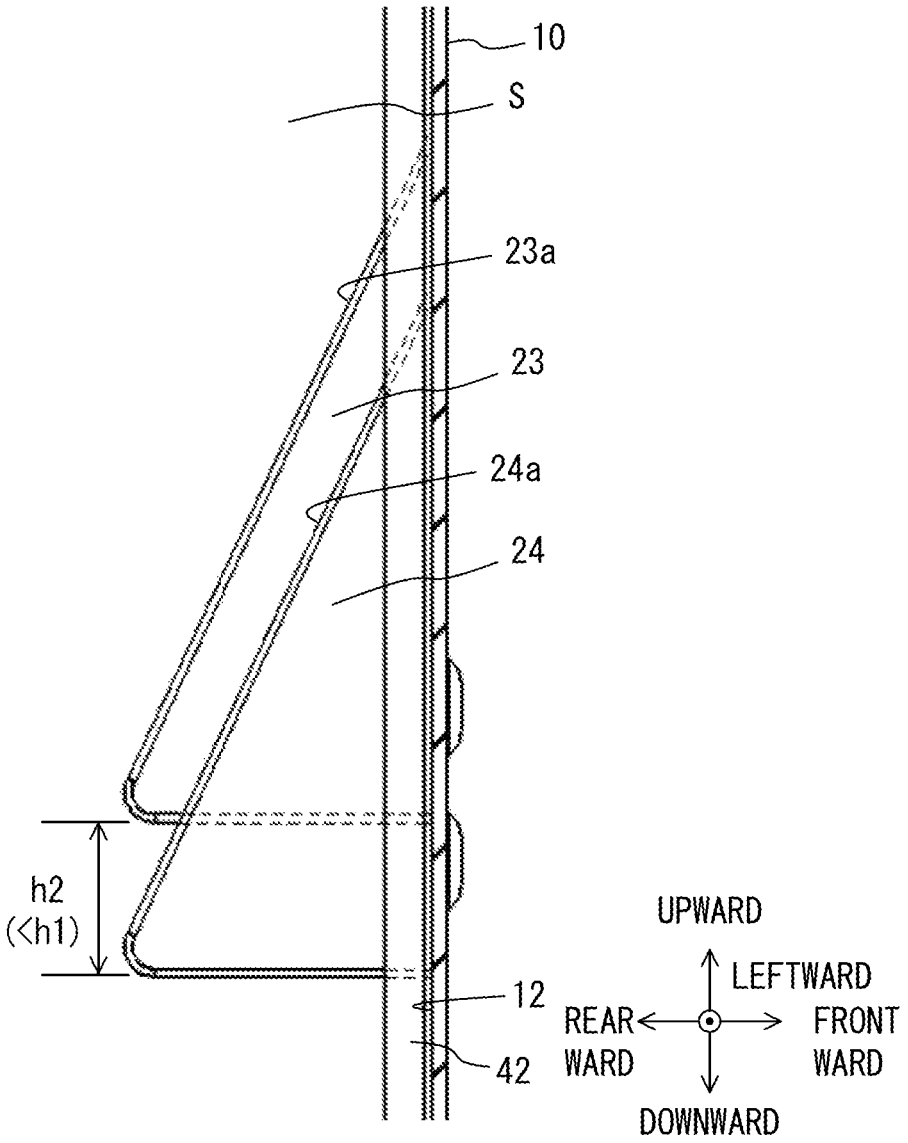
FIG. 10 is an enlarged view of a part X illustrated in FIG. 6.

FIG. 10 is an enlarged view of a part X illustrated in FIG. 6.

As illustrated in FIGS. 5 and 6, the first reject storage 1 includes a storage 10 and the first to fourth guide portions 21 to 24. As illustrated in FIG. 6, the first reject storage 1 further includes a conveyance section 30, a first rib 41, and a second rib 42.

As illustrated in FIG. 8, the storage 10 illustrated in FIG. 6 stores the banknote B inclined with respect to the horizontal direction in a storage space S narrower than the banknote B in width in the front-rear direction.

The first to fourth guide portions 21 to 24 protrude from an inner wall of the storage 10 toward the storage space S. The first to fourth guide portions 21 to 24 have guide surfaces 21*a* to 24*a* inclined downward with respect to the horizontal direction toward the storage space S from the inner wall of the storage 10. Note that the first to fourth guide portions 21 to 24 have, for example, horizontal lower ends and thus have a triangular shape in the left side view illustrated in FIG. 6.

As illustrated in FIG. 9, which is an enlarged view of the part IX illustrated in FIG. 6, the first guide portion 21 and the second guide portion 22 are arranged side by side at positions (difference h1 in height) different from each other in height on a first surface 11, which is the same surface of the inner wall of the storage 10. As a result, as illustrated in FIG. 5, the first guide portion 21 and the second guide portion 22 guide the banknote B so as to cause the banknote B to freely fall in the storage space S such that all sides of the banknote B are inclined at an angle different from the horizontal direction. However, when the banknote B is inclined until the diagonal line of the banknote B becomes close to the vertical direction, the orientation of the banknote B changes. Therefore, the angle at which the banknote B is inclined is preferably, for example, 45 degrees or less. Of the first guide portion 21 and the second guide portion 22, the first guide portion 21 located on the right side is located above the second guide portion 22.

As the fall trajectory T is indicated by an alternate long and short dashed line in FIG. 7, for example, the banknote B falling in the storage space S falls from the conveyance section 30 to be described later such that the lower end of the banknote B contacts the guide surfaces 21*a* and 22*a* of the first guide portion 21 and the second guide portion 22, a second surface 12 (the second rib 42), the guide surfaces 23*a* and 24*a* of the third guide portion 23 and the fourth guide portion 24, the first surface 11 (the first rib 41), and a bottom plate 13 in this order. As a matter of course, due to an increase in the number of banknotes B stored in the storage space S, the banknotes B are stacked at a position halfway along the fall trajectory T.

As illustrated in FIG. 10 which is an enlarged view of the part X illustrated in FIG. 6, the third guide portion 23 and the fourth guide portion 24 are arranged side by side at positions (difference h2 in height) different from each other in height below the first guide portion 21 and the second guide portion 22 on the second surface 12 which is a surface of the inner wall of the storage 10 facing the first surface 11 on which the first guide portion 11 and the second guide portion 12 are arranged. As a result, as illustrated in FIG. 5, the third guide portion 23 and the fourth guide portion 24 guide the banknote B so as to cause the banknote B to freely fall in the storage space S with all the sides of the banknote B inclined at an angle different from the horizontal direction. Of the third guide portion 23 and the fourth guide portion 24, the third guide portion 23 located on the right side similarly to the first guide portion 21 is located above the fourth guide portion 24.

The difference h2 in height between the third guide portion 23 and the fourth guide portion 24 is preferably smaller than the difference h1 in height between the first guide portion 21 and the second guide portion 22 ($h2<h1$). This is because the banknote B is already guided by the first guide portion 21 and the second guide portion 22, so that the banknote B freely fall such that all the sides of the banknote B are inclined at an angle different from the horizontal direction, and even when the difference h2 in height between the third guide portion 23 and the fourth guide portion 24 is small, the banknote B can freely fall such that all the sides of the banknote B are inclined at an angle different from the horizontal direction. Further, as the difference h2 in height between the third guide portion 23 and the fourth guide portion 24 is reduced, the amount of banknotes B stacked around the third guide portion 23 and the fourth guide portion 24 can be increased.

Note that the guide portions that guide the banknote B so as to cause the banknote B to freely fall in the storage space S such that all the sides of the banknote B are inclined at an angle different from the horizontal direction are not limited to the first to fourth guide portions 21 to 24 protruding from the inner wall of the storage 10 toward the storage space S. For example, when the conveyance section 30 conveys the banknote B at different rotation speeds on the left side and the right side, the conveyance section 30 guides the banknote B so as to cause the banknote B to freely fall in the storage space S such that all the sides of the banknote B are inclined at an angle different from the horizontal direction, and thus the conveyance section 30 functions as a guide portion.

In addition, in the present embodiment, the third guide portion 23 and the fourth guide portion 24 are arranged in addition to the first guide portion 21 and the second guide portion 22, but only the first guide portion 21 and the second guide portion 22, or only the third guide portion 23 and the fourth guide portion 24 may be arranged, and the number of guide portions may be arbitrarily set.

In addition, in the present embodiment, the first guide portion 21 and the second guide portion 22 are arranged side by side at positions different from each other in height, and the third guide portion 23 and the fourth guide portion 24 are arranged side by side at positions different from each other in height. However, a single guide portion in which the first guide portion 21 and the second guide portion 22 are integrated or the third guide portion 23 and the fourth guide portion 24 are integrated may have a guide surface whose height varies over the left-right direction. Alternatively, even in a case where the first guide portion 21 and the second guide portion 22 are arranged at the same height position and the third guide portion 23 and the fourth guide portion 24 are arranged at the same height position, when the guide surface 21*a* of the first guide portion 21 and the guide surface 22*a* of the second guide portion 22 or the guide surface 23*a* of the third guide portion 23 and the guide surface 24*a* of the fourth guide portion 24 have different surface roughness, it is possible to guide the banknote B so as to cause the banknote B to freely fall in the storage space S such that all the sides of the banknote B are inclined at an angle different from the horizontal direction.

The conveyance section 30 illustrated in FIGS. 6 to 8 conveys the banknote B conveyed to the first reject storage 1 by conveyance rollers 31 to 33 downward and causes the banknote B to freely fall in the storage space S. The conveyance section 30 may include another conveyance member (for example, an impeller) instead of the conveyance rollers 31 to 33 or together with the conveyance rollers 31 to 33.

The first rib 41 and the second rib 42 illustrated in FIGS. 6 to 8 are provided by, for example, drawing so as to protrude from the inner wall of the storage 10. In a case where the first rib 41 and the second rib 42 are provided by drawing in this manner, the strength of the first surface 11 and the second surface 12 can be increased. Note that each of the first rib 41 and the second rib 42 is preferably provided over substantially the entire height of the storage space S, for example, such that a plurality of ribs (for example, three ribs) are arranged side by side in the left-right direction so as to sandwich the guide portions.

The first rib 41 and the second rib 42 protrude from the inner wall of the storage 10 by amounts smaller than those of the first to fourth guide portions 21 to 24. Upper end tapered portions 41*a* and 42*a* that protrude by amounts that decrease toward the upper ends are provided at the upper ends of the first rib 41 and the second rib 42. The first rib 41 and the second rib 42 suppress the banknote B from being caught on the upper ends of the guide surfaces 21*a* to 24*a* of the first to fourth guide portions 21 to 24.

In the present embodiment described above, the first reject storage 1, which is an example of the paper sheet storage device, includes the storage 10 that stores the banknote B inclined with respect to the horizontal direction in the storage space S narrower than the banknote B in width, which is an example of the paper sheet, and the first to fourth guide portions 21 to 24, which are examples of a guide portion that guides the banknote B so as to cause the banknote B to freely fall in the storage space S such that all the sides of the banknote B are inclined at an angle different from the horizontal direction.

As described above, with the simple configuration in which the first to fourth guide portions 21 to 24 guide the banknote B so as to cause the banknote B to freely fall in the storage space S such that all the sides of the banknote B are inclined at an angle different from the horizontal direction, the banknote B falls with its corner as a lower end. Therefore, it is possible to suppress a side (end face) of the freely falling banknote B from coming into contact with a side of a stored banknote B. Therefore, it is possible to prevent the banknote B from being stacked on the side of the banknote B.

Therefore, according to the present embodiment, it is possible to secure the number of banknotes B to be stored in the storage space S narrower than the banknotes B in width with the simple configuration. In addition, since the first reject storage 1 and thus the automatic dealing apparatus 100 can have a simple configuration, the cost can be reduced.

In the present embodiment, the first to fourth guide portions 21 to 24 protrude from the inner wall of the storage 10 toward storage space S. The first to fourth guide portions 21 to 24 have the guide surfaces 21*a* to 24*a* inclined downward with respect to the horizontal direction toward the storage space S from the inner wall of the storage 10. As a result, with the simple configuration in which the first to fourth guide portions 21 to 24 protrude from the inner wall of the storage 10, the banknote B can be prevented from leaning on the first to fourth guide portions 21 to 24 by causing the center of gravity of the banknote B to act obliquely downward. Therefore, it is possible to further secure the number of banknotes B to be stored in the storage space S.

Further, in the present embodiment, the first reject storage 1 includes the plurality of guide portions including the first guide portion 21 and the second guide portion 22, and the first guide portion 21 and the second guide portion 22 are arranged side by side at positions different from each other in height on the first surface 11 which is the same surface of the inner wall of the storage 10. As a result, with the simple configuration in which the height positions of the first guide portion 21 and the second guide portion 22 are shifted, the banknote B can be guided so as to freely fall in the storage space S such that all the sides of the banknote B are inclined at an angle different from the horizontal direction.

Further, in the present embodiment, the plurality of guide portions further include the third guide portion 23 and the fourth guide portion 24, and the third guide portion 23 and the fourth guide portion 24 are arranged below the first guide portion 21 and the second guide portion 22 and side by side at positions different from each other in height by the difference h2 smaller than the difference h1 in height between the first guide portion 21 and the second guide portion 22 on the second surface 12 of the inner wall of the storage 10 facing the first surface 11 on which the first guide portion 21 and the second guide portion 22 are arranged. As a result, the banknote B guided by the first guide portion 21 and the second guide portion 22 so as to freely fall such that all the sides of the banknote B are inclined at an angle different from the horizontal direction can be guided so as to freely fall while all the sides are maintained to be inclined at an angle different from the horizontal direction. Furthermore, by making the difference h2 in height between the third guide portion 23 and the fourth guide portion 24 smaller than the difference h1 in height, the amount of banknotes B stacked around the third guide portion 23 and the fourth guide portion 24 can be increased as compared with a case where the difference in height is larger.

In the present embodiment, the first reject storage 1 further includes the first rib 41 and the second rib 42 which are examples of a rib. The first rib 41 and the second rib 42 protrude from the inner wall toward the storage space S by protrusion amounts smaller than the protrusion amounts of the first to fourth guide portions 21 the 24 from the inner wall of the storage 10, and suppress the banknote B from being caught on the upper ends of the guide surfaces 21*a* to 24*a*. As a result, it is possible to suppress the banknote B from being caught on the upper ends of the guide surfaces 21*a* to 24*a* and falling on an unintended trajectory. Therefore, it is possible to further secure the number of banknotes B to be stored in the storage space S.

Note that the present invention is not limited to the above-mentioned embodiment as it is, and can be embodied by modifying components thereof. For example, various inventions can be formed by appropriately combining a plurality of components disclosed in the present embodiment. Various modifications of the invention and applications can be made without departing from the spirit of the invention.

The invention claimed is:

1. A paper sheet storage device comprising:

a storage that stores a paper sheet inclined with respect to a horizontal direction in a storage space narrower than the paper sheet in width; and a plurality of guide portions including a first guide portion and a second guide portion that protrude from an inner wall of the storage toward the storage space and guide the paper sheet, wherein:

the plurality of guide portions has a guide surface inclined downward with respect to the horizontal direction toward the storage space from the inner wall, the first guide portion and the second guide portion are arranged side by side at positions different from each other in height on a same surface of the inner wall so as to incline a laterally extending edge of the paper sheet at an angle of 45 degrees or less from the horizontal direction, the plurality of guide portions further includes a third guide portion and a fourth guide portion, and the third guide portion and the fourth guide portion are arranged below the first guide portion and the second guide portion and horizontally side by side at positions different from each other in height by a difference smaller than a difference in height between the first guide portion and the second guide portion on a surface of the inner wall facing the surface on which the first guide portion and the second guide portion are disposed.

2. The paper sheet storage device according to claim 1, further comprising:

a rib that protrudes from the inner wall toward the storage space by a protrusion amount smaller than protrusion amount of the plurality of guide portions from the inner wall and suppresses the paper sheet from being caught on an upper end of the guide surface.

3. A paper sheet handling device comprising a paper sheet storage device, the paper sheet storage device including:

a storage that stores a paper sheet inclined with respect to a horizontal direction in a storage space narrower than the paper sheet in width;

a plurality of guide portions including a first guide portion and a second guide portion that protrude from an inner wall of the storage toward the storage space and guide the paper sheet, wherein:

the plurality of guide portions has a guide surface inclined downward with respect to the horizontal direction toward the storage space from the inner wall, the first guide portion and the second guide portion are arranged side by side at positions different from each other in height on a same surface of the inner wall so as to incline a laterally extending edge of the paper sheet at an angle of 45 degrees or less from the horizontal direction, the plurality of guide portions further includes a third guide portion and a fourth guide portion, and the third guide portion and the fourth guide portion are arranged below the first guide portion and the second guide portion and horizontally side by side at positions different from each other in height by a difference smaller than a difference in height between the first guide portion and the second guide portion on a surface of the inner wall facing the surface on which the first guide portion and the second guide portion are disposed.

4. A paper sheet storage device comprising:

a storage that stores a paper sheet inclined with respect to a horizontal direction in a storage space narrower than the paper sheet in width; and a plurality of guide portions including a first guide portion and a second guide portion that protrude from an inner wall of the storage toward the storage space and guide the paper sheet, wherein:

the plurality of guide portions each have a guide surface inclined downward with respect to the horizontal direction toward the storage space from the inner wall, the first guide portion and the second guide portion are arranged side by side such that a lowermost edge of the guide surface of the first guide portion and a lowermost edge of the guide surface of the second guide portion are located at positions different from each other in height on a same surface of the inner wall so as to incline a laterally extending edge of the paper sheet at an angle of 45 degrees or less from the horizontal direction, the plurality of guide portions further includes a third guide portion and a fourth guide portion, and the third guide portion and the fourth guide portion are arranged below the first guide portion and the second guide portion and horizontally side by side at positions different from each other in height by a difference smaller than a difference in height between the first guide portion and the second guide portion on a surface of the inner wall facing the surface on which the first guide portion and the second guide portion are disposed.

* * * * *